United States Patent [19]

Wakatsuki et al.

[11] 4,325,265

[45] Apr. 20, 1982

[54] STARTER DEVICE FOR INTERNAL COMBUSTION ENGINE

[75] Inventors: Goroei Wakatsuki, Fujimi; Masahide Yokoo, Tsurugashima, both of Japan

[73] Assignee: Honda Giken Kogyo Kabushiki Kaisha, Tokyo, Japan

[21] Appl. No.: 126,719

[22] Filed: Mar. 3, 1980

[30] Foreign Application Priority Data

| | | | |
|---|---|---|---|
| Mar. 2, 1979 | [JP] | Japan | 54/24185 |
| Mar. 5, 1979 | [JP] | Japan | 54/27711[U] |
| Mar. 19, 1979 | [JP] | Japan | 54/35310[U] |

[51] Int. Cl.[3] ..... F02N 15/06

[52] U.S. Cl. ..... 74/7 R; 192/114 R

[58] Field of Search ..... 74/6, 7 R, 7 A; 192/114 R

[56] References Cited

U.S. PATENT DOCUMENTS

| | | | |
|---|---|---|---|
| 2,787,910 | 4/1957 | Sabatini | 74/7 |
| 3,090,242 | 5/1963 | Sabatini | 74/7 |
| 3,306,409 | 2/1967 | Giometti | 192/114 R X |
| 3,458,019 | 7/1969 | Fant et al. | 74/6 X |
| 3,741,021 | 6/1973 | Parsons | 74/7 R |

*Primary Examiner*—Allan D. Herrmann

*Attorney, Agent, or Firm*—Irving M. Weiner; Pamela S. Burt; John L. Shortley

[57] ABSTRACT

A starter device for an internal combustion engine which includes a starter motor, a pinion shaft rotated by the starter motor, a movable cylindrical member fitted on the pinion shaft and coupled thereto by a helical spline coupling, a pinion gear fitted for free rotation on the pinion shaft, a unidirectional clutch provided between the pinion gear and the movable cylindrical member, and the pinion gear and movable cylindrical member being coupled together for axial movement in unison with each other. In order to prevent the pinion gear from premature detachment from a ring gear of the internal combustion engine before the stable running condition of the internal combustion engine is reached, the device further includes: a pinion gear retreat-prevention member provided on the outer periphery of the movable cylindrical member, the pinion gear retreat-prevention member being axially fixed in position but radially movable relative to the movable cylindrical member; and a lock member provided at a position in the vicinity of the pinion gear retreat-prevention member so as to be engageable with the pinion gear retreat-prevention member in a state thereof when it is radially displaced by centrifugal forces.

18 Claims, 9 Drawing Figures

STARTER DEVICE FOR INTERNAL COMBUSTION ENGINE

BACKGROUND OF THE INVENTION

1. Field of the Invention

The present invention relates to "Bendix" type starters for starting internal combustion engines of motorcycles and the like. More particularly, the invention relates to a starter device provided with means for preventing premature retreat of the pinion gear thereof at an initial unstable stage of the internal combustion engine when it is started.

2. Description of Relevant Art

A "Bendix" drive or "inertial" type starter is well known in the art for use as a device for starting an internal combustion engine of a motorcycle or other vehicle. Such type of starter comprises a pinion gear fitted on a pinion shaft rotated by a starter motor and a movable cylindrical member coupled to the pinion gear through a unidirectional clutch, the movable cylindrical member being fitted on the pinion shaft and coupled thereto by a helical spline coupling. When the pinion shaft is rapidly rotated by the starter motor, the movable cylindrical member and pinion gear are caused to move or slide along the pinion shaft due to their inertia, and the pinion gear is brought into mesh with a ring gear of the engine as the pinion gear reaches the end of the pinion shaft. As a result, the ring gear is rotated by the pinion gear, to thus start the engine. After the engine has been started, the unidirectional clutch permits free rotation of the pinion gear relative to the movable cylindrical member. When the rpm (revolutions per minute) of the pinion gear is increased beyond that of the pinion shaft with forced torque received from the ring gear and reaches a predetermined rpm, the pinion gear and movable cylindrical member are retreated along the pinion shaft by dragging torque of the unidirectional clutch and a spring force of a return spring, so that the ring gear is released from the pinion gear.

It is known that the engine does not reach a stable running condition immediately after ignition. During a certain initial period after starting the engine, the rpm fluctuates and momentarily reaches a rpm at which the pinion gear is permitted to be detached from the ring gear. Accordingly, there has been known a device in which the premature releasing of the meshing engagement between the pinion gear and ring gear is prevented by a detachment-prevention member such as a slide pin until the condition of the engine is stable, with a constant rpm. This type of device, however, is unsatisfactory and indeed substantially infeasible for single-cylinder engines or two-cycle engines of motorcycles and the like, the rpm of which fluctuates considerably.

When the pinion gear is detached from the ring gear and prematurely retreated due to fluctuations of the rpm of the engine during the initial unstable stage thereof, before reaching its stable running condition, an igniter malfunctions, and the engine is consequently stopped. Such condition is shown in FIG. 9 in the form of a graph, wherein the ordinate represents the rpm (N), and the abscissa represents the time (T). During the initial stage after starting the engine, the rpm thereof fluctuates in a wavy fashion, and the rpm of the pinion gear similarly fluctuates as shown in the graph and momentarily reaches a high rpm A. The pinion shaft is rotated at a rpm B which is determined by the starter motor. When the rpm of the pinion gear afforded by the ring gear exceeds the rpm of the pinion shaft as such rpm of the pinion gear momentarily reaches the high value A, a force tending to detach and retreat the pinion gear from the ring gear is produced due to dragging torque provided by the unidirectional clutch, thus causing premature detachment of the pinion gear from the ring gear before the engine has reached its stable running condition. Therefore, a failure in ignition results which causes the engine to stop. In such event, it is necessary to stop the starter motor once and operate a switch therefor again, which operation is time-consuming and inconvenient.

The aforesaid problem may be solved by employing a starter motor wherein the rpm B of the pinion shaft is always higher than the momentary peak rpm A of the pinion gear, even if the rpm of the engine fluctuates. However, such a starter motor requires a high torque, a high capacity, and high rpm ratings, which necessitates a larger size of the starter motor. Accordingly, such a starter motor is highly undesirable from the standpoint of the demand for reducing the size of starter motors.

Another important aspect of achieving reliable performance of the "Bendix" type starter is to ensure that the pinion gear moves smoothly along the pinion shaft. The various components of the starter, including the pinion gear and movable cylindrical member, are assembled in a case filled with lubricating oil. At some time in the course of repeated use of the starter over a long period of time, dust eventually drops into the lubricating oil. The contained dust attaches itself to the surface of the pinion shaft and obstructs the frictional movement of the pinion gear. Also, if dust intrudes into the gap between the pinion gear and pinion shaft, smooth movement of the pinion gear is impeded, and in extreme cases the engine can no longer be started. Thus, it is necessary to guarantee smooth frictional movement of the pinion gear along the pinion shaft without being adversely affected by dust.

The present invention effectively overcomes the above-described problems inherent in known starter constructions.

SUMMARY OF THE INVENTION

The present invention provides a starter device for an internal combustion engine, which comprises a starter motor, a pinion shaft rotated by the starter motor, and a movable cylindrical member fitted on the pinion shaft and coupled thereto by a helical spline coupling. A pinion gear is fitted for free rotation on the pinion shaft, and a unidirectional clutch is provided between the pinion gear and movable cylindrical member. The pinion gear and movable cylindrical member are coupled together through the unidirectional clutch for axial movement in unison with each other, and a member for preventing retreat of the pinion gear is provided on the outer periphery of the movable cylindrical member. The pinion gear retreat-prevention member is axially restricted in position but is radially movable relative to the movable cylindrical member, and a lock member is provided at a position in the vicinity of the pinion gear retreat-prevention member so as to be engageable with the pinion gear retreat-prevention member when it is radially displaced by centrifugal forces.

An object of the invention is to provide a starter device for an internal combustion engine whereby premature detachment of the pinion gear from the ring gear before establishment of the stable running condition of the engine is prevented by the engagement between the pinion gear retreat-prevention member and lock member. Accordingly, the rpm or rotational speed of the pinion shaft need not be made higher than the momentary peak value of the rpm of the pinion gear during the state when the pinion gear rpm fluctuates, thus permitting substantial reduction of the size and capacity of the starter motor.

The invention also provides a starter device for an internal combustion engine wherein the pinion gear retreat-prevention member comprises a governor weight including a plurality of segments adapted to experience centrifugal forces at the time of rotation of the pinion shaft. Each of the governor weight segments is provided at its inner periphery with a groove loosely fitted on the outer periphery of a governor holder having a substantially ring-like form and being secured to the movable cylindrical member, or each governor segment is interposed between the governor holder and a plate ring secured in axially spaced-apart relation to the movable cylindrical member. Thus, the governor weight is capable of being displaced radially outwardly by centrifugal forces and of engaging with the lock member.

The invention further provides a starter device for an internal combustion engine wherein a ring-like spring is mounted on the outer periphery of the governor weight to provide a radially-inward biasing force to all of the governor weight segments so that the governor weight is urged and held in its radially innermost position when the pinion shaft is rotated.

The invention further provides a starter device for an internal combustion engine wherein the lock member comprises a hollow cylindrical governor case coaxially secured to the pinion shaft so as to accommodate the governor weight. The governor case includes a rear small-diameter portion, a large-diameter portion, and a shoulder defined between the rear and front portions, the shoulder being adapted to be engaged by the governor weight when it is displaced radially outwardly by centrifugal forces, thus preventing the pinion gear from being prematurely detached from the ring gear.

The invention further provides a starter device for an internal combustion engine wherein the pinion gear has an integral front extension, and a stopper member is secured to the pinion shaft at a position near the front end thereof. The stopper member has a hollow cylindrical configuration including a cylindrical portion extending toward the pinion gear, the surface of the pinion shaft being thus substantially covered by the extension and cylindrical portion in the retreated position of the pinion gear. Thus, attachment of dust contained in the lubricating oil to the pinion shaft is prevented, and smooth frictional movement of the pinion gear is ensured.

The above and further objects, details and advantages of the present invention will become more apparent from the following detailed description of preferred embodiments of the invention, when read in conjunction with the accompanying drawings.

DETAILED DESCRIPTION OF PREFERRED EMBODIMENTS

Figure 1:
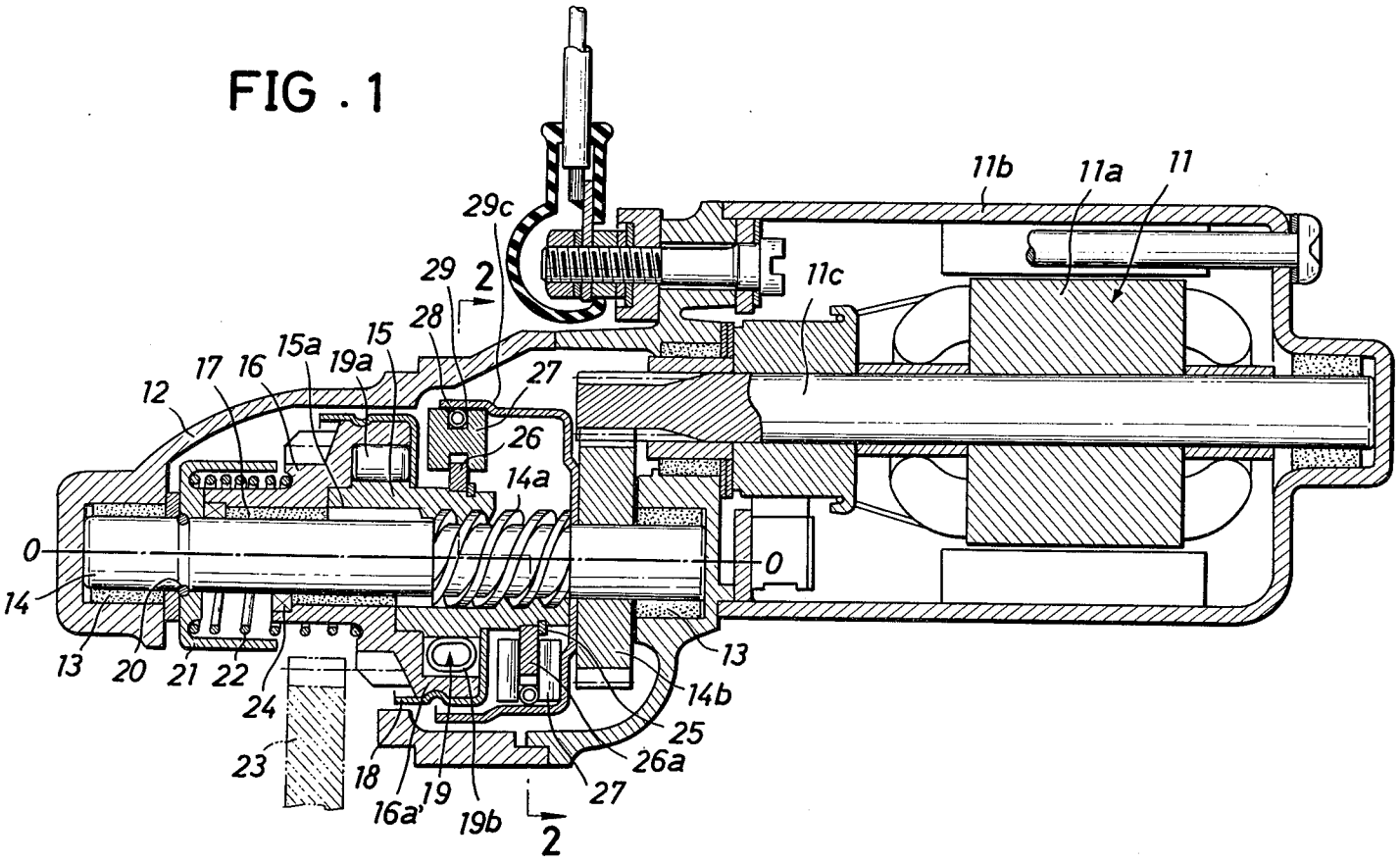
FIG. 1 is an axial sectional view of a starter device according to the invention, with component parts including a pinion gear and movable cylindrical member being shown in their advanced position in the upper half of the Figure over an axis 0—0 of the pinion shaft, and in their retreated position in the lower half of the Figure.

Referring to FIG. 1, a casing 12 is mounted on a starter motor 11 having an internal armature 11*a*. The casing 12 projects forwardly from a starter housing 11*b* of the starter motor 11, and accommodates necessary parts assembled therewithin.

A pinion shaft 14 extending in the interior of casing 12 is journalled in bearing bushes 13. The shaft 14 carries a reduction gear 14*b* secured to its rear end portion and meshing with a drive shaft 11*c* of the starter motor 11 so that the drive force of the starter motor 11 is transmitted through the gear 14*b* to the shaft 14. Assembled on shaft 14 is a movable member 15 having a substantially cylindrical configuration, and a pinion gear 16. The shaft 14 and movable cylindrical member 15 are coupled together by a helical spline coupling with a helical spline 14*a* of a predetermined length formed in shaft 14 and a helical spline 15*a* formed in the inner wall of the movable cylindrical member 15. The pinion gear 16 is fitted for free rotation on shaft 14 via a bush 17. The pinion gear 16 has a rear increased-diameter portion 16*a*′, into which a front portion of the movable cylindrical member 15 extends, and the movable cylindrical member 15 and pinion gear 16 are coupled together by a cover member 18 secured to the increased-diameter portion 16*a*′ such that they are moved together in the axial direction.

A unidirectional clutch 19 including a roller 19*a* and a spring 19*b* is provided in a radially intermediate space between the increased-diameter portion 16*a*′ of the pinion gear 16 and the front portion of the movable cylindrical member 15 inserted in the increased-diameter portion 16*a*′. The clutch 19 functions to permit free rotation of pinion gear 16 relative to movable cylindrical member 15 in a particular direction, and to prevent free relative rotation in the other direction, thus causing pinion gear 16 to rotate in unison with movable cylindrical member 15 in such other direction. In this arrangement, the movable cylindrical member 15 serves as an inner clutch member while the pinion gear 16 serves as an outer clutch member.

Figure 2:
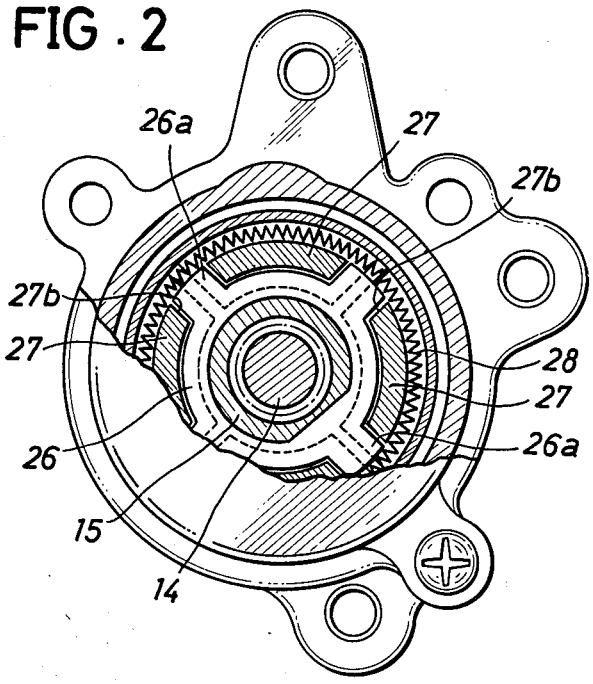
FIG. 2 is a section taken along line 2—2 in FIG. 1.
Figure 3:
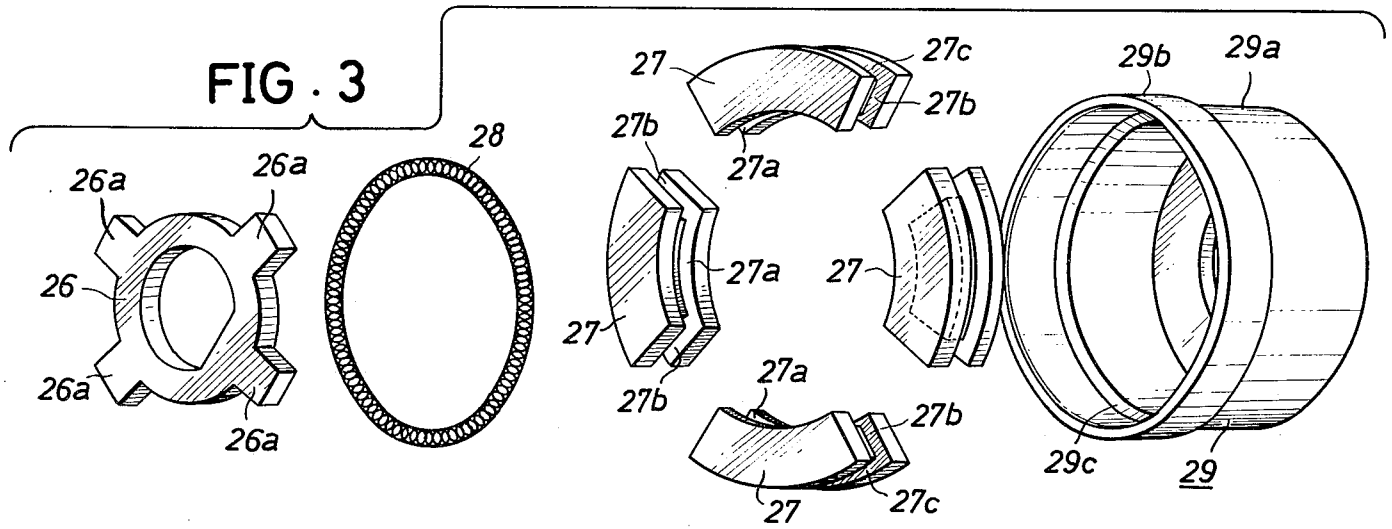
FIG. 3 is an exploded perspective view showing a governor weight and other component parts.

A governor holder 26, which has a substantially ring-like form as shown in FIGS. 2 and 3, is fitted on the outer periphery of a rear portion of movable cylindrical member 15 and secured in position in both the axial and rotational directions. A governor weight 27, which is an element for checking the retreat of the pinion gear, comprises a plurality of (i.e., four in the present embodiment), separate segments, and the governor holder 26 has uniformly spaced-apart projections 26*a* which extend between adjacent governor weight pieces 27 when these pieces are assembled. As shown in FIG. 3, each of the governor weight pieces 27 has its inner periphery formed with a guide groove 27*a* of a suitable depth. The guide groove 27*a* extends to each opposite end of the arcuate weight governor piece 27, and terminates in end grooves 27*b* formed in the opposite ends of the arcuate governor piece 27, and extending in the radial direction. Further, the governor weight piece 27 has its outer periphery formed with a spring accommodating groove 27*c* having a suitable depth and extending up to the opposite ends of the arcuate piece. Each governor weight piece 27 is mounted on the governor holder 26 with the inner peripheral guide groove 27*a* fitted on the governor holder 26 so that the piece 27 cannot be moved relative to the holder in the axial direction but is radially movable by virtue of the guide groove 27*a*. Further, the end grooves 27*b* of each governor weight piece 27 are fitted on respective adjacent projections 26*a* of the governor holder 26 so that the governor weight piece 27 can rotate in unison with the movable cylindrical member 15 and governor holder 26. The loose engagement between the end grooves 27*b* and the projections 26*a* also ensures that the governor weight piece 27 is axially fixed in position but is radially movable relative to governor holder 26. A ring-like coil spring 28 is accommodated in the outer peripheral grooves 27*c* formed in the individual governor weight pieces 27, which are thus mounted on and retained by the governor holder 26 integral with the movable cylindrical member 15. The spring 28 exerts a compressive spring force to, and radially inwardly biases, the governor weight pieces 27. Normally, i.e., when the pinion shaft 14 is not rotated, the governor weight pieces 27 are held in their radially innermost position by the biasing force of the spring 28. As shown in FIG. 1, the governor weight 27 is surrounded by a governor case 29, which is open at its front end and has a closed rear end. The governor case 29 is coaxially secured to the pinion shaft 14, for instance, by securing its closed rear end to the reduction gear 14*b*. The case 29 serves as a lock member and, as shown in FIG. 3, includes a rear small diameter portion 29*a*, a front large diameter portion 29*b* and a shoulder portion 29*c* between the small and large diameter portions 29*a* and 29*b*. When the movable cylindrical member 15 and pinion gear 16 are in their retreated position, the governor weight 27 is accommodated within the small diameter portion 29*a* in a spaced-apart relation to the inner wall of the portion 29*a*.

Figure 4:
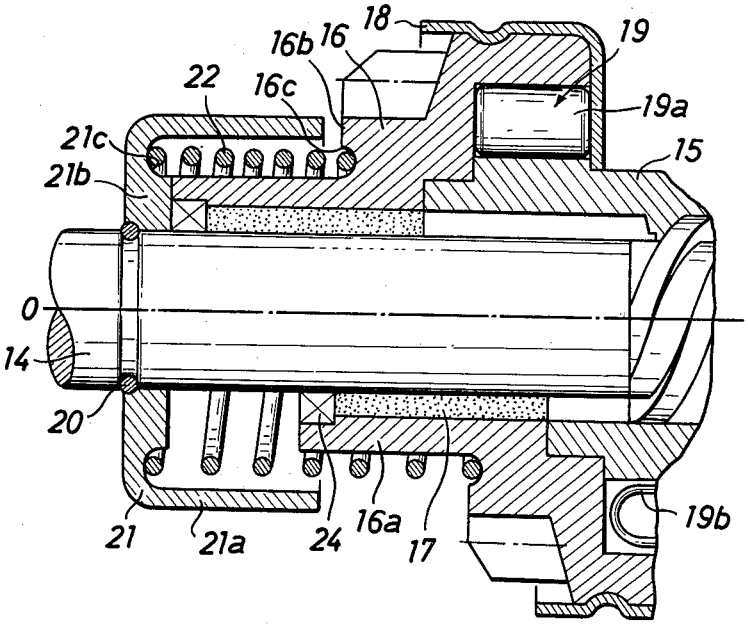
FIG. 4 is a fragmentary enlarged sectional view showing the embodiment of FIG. 1.

As shown in detail in FIG. 4, the pinion gear 16 has an integral cylindrical front extension 16*a* extending in the direction of its advancement, i.e., extending toward the internal combustion engine, and having a suitable length in the axial direction. The pinion shaft 14 is provided with a stopper member 21 secured by a clip 20 to the front end thereof. The stopper member 21 has a hollow cylindrical configuration having a closed front end engaging with the clip 20 and an open rear end on the side of the pinion gear 16. The cylindrical portion 21*a* extending from the closed end of stopper member 21 toward the pinion gear 16 has an inner diameter greater than the outer diameter of the extension 16*a* of the pinion gear 16 so that the extension 16*a* can enter into the cylindrical portion 21*a*. A return spring 22 which comprises a compression coil spring having an inner diameter slightly greater than the outer diameter of the extension 16*a* is interposed between the closed end of the stopper member 21 and the pinion gear 16 proper. Spring 22 extends between the outer periphery of the extension 16*a* and the inner periphery of the cylindrical portion 21*a*. Detachment of the return spring 22 is prevented by the forming of grooves 21*c* and 16*c* in the inner wall of the closed end 21*b* of the stopper member 21 and the shoulder 16*b* of the pinion gear 16, respectively, the opposite ends of the return spring 22 being engaged in grooves 21*c* and 16*c*. The same effect is also provided by the cylindrical portion 21*a* itself.

With the front extension 16*a* provided integrally with the pinion gear 16, the length of contact of the pinion gear 16 with the pinion shaft 14 is substantially increased, which has the effect of preventing tilting of the pinion gear 16 at the time of its movement, and thus preventing rattling or partial wear of the pinion gear 16.

The length of the cylindrical portion 21*a* of the stopper member 21, which engages with and supports one end of the return spring 22 and also serves as a cover for the spring 22, is appropriately set in connection with the length of the extension 16*a* of the pinion gear 16. More particularly, the lengths of the extension 16*a* and cylindrical portion 21*a* are set such that in the retreated position of the pinion gear 16 before the driving of starter motor 11, the end of the extension 16*a* extends slightly into the cylindrical portion 21*a* as shown in the lower half portion in FIGS. 1 and 4 under the axis 0—0, or at least they define only a slight gap between them. Thus, even at the time when the pinion gear 16 is retreated, the surface of the pinion shaft 14, over which the pinion gear 16 is moved in frictional contact therewith, is substantially covered. Further, a dust seal 24 is fitted in an inner periphery of the extension 16*a* so as to be in frictional engagement with the pinion shaft 14 extending through pinion gear 16.

A ring gear 23 of an internal combustion engine for a motorcycle or the like is disposed between the stopper member 21 and pinion gear 16 at the time when the movable cylindrical member 15 and pinion gear 16 are retreated as shown in the lower half in FIG. 1 under the axis 0—0. When the movable cylindrical member 15 and pinion gear 16 are advanced, the pinion gear 16 meshes with the ring gear 23 as shown in the upper half portion of FIG. 1 over the axis 0—0.

The operation of the above-described arrangement will now be described in detail hereinbelow.

When the starter motor 11 is driven by turning on a switch, the pinion shaft 14 is rotated through the reduction gear 14*b*. With the rapid rotation of pinion shaft 14 brought about at such time, the movable cylindrical member 15 which is coupled to the pinion shaft 14 by the helical spline coupling is caused to move forwardly along the pinion shaft 14 due to its inertia without relative rotation. Thus, the pinion gear 16 is also moved along the pinion shaft 14 and compresses return spring 22. Thus, pinion gear 16 is brought into meshing engagement with ring gear 23 of the internal combustion engine. When the pinion gear 16 is brought into engagement with the stopper member 21 which also serves as a cover for limiting advancement of pinion gear 16, the movable cylindrical member 15 and pinion gear 16 begin to rotate in unison with the pinion shaft 14, whereby the ring gear 23 is rotated by the torque transmitted from the pinion shaft 14 transmitted through the movable cylindrical member 15 and unidirectional clutch 19 to obtain starting ignition of the internal combustion engine. After the start of the internal combustion engine, when the rotational speed of pinion gear 16 will become higher than that of pinion shaft 14 and movable cylindrical member 15 due to forced torque transmitted to the pinion gear 16 from ring gear 23, the unidirectional clutch 19 permits free rotation of the pinion gear 16 relative to the movable cylindrical member 15.

In the above operation, at the time when the movable cylindrical member 15 begins to rotate in unison with the pinion shaft 14 after the start of rotation of shaft 14, the governor weight pieces 27 with their grooves 27*a* fitted on the governor holder 26 integrally with the movable cylindrical member 15 are radially outwardly displaced by centrifugal forces against the radially-inward biasing force of coil spring 28. At this time, the governor weight 27 has been displaced from the small diameter portion 29*a* of the governor case 29 to the large diameter portion 29*b* thereof with the displacement of the movable cylindrical member 15 along the pinion shaft 14, with the rear side of the governor weight 27 being in contact with or being slightly spaced apart from and facing the shoulder 29*c* of the governor case 29.

After the internal combustion engine has been started with the rotation of the ring gear 23 caused by the pinion gear 16, in the initial stage of the engine operation the engine rpm is subject to fluctuations as described hereinabove. However, even if the rpm of the pinion gear 16 momentarily reaches a value at which the pinion gear 16 would otherwise detach from the ring gear 23, the detachment of the gear 16 from gear 23 and retreat of gear 16 along the pinion shaft 14 to the initial position thereof are prevented, due to the abutment of governor weight 27 against the shoulder 29*c* of governor case 29. In other words, premature detachment of pinion gear 16 from ring gear 23 during the unstable initial period after starting of the internal combustion engine will be positively prevented. Thus, as long as the rotation of pinion shaft 14 is continued by starter motor 11, torque can be transmitted from pinion gear 16 to ring gear 23, i.e., the engine starting force can be given to the internal combustion engine until the stable condition of the engine is reached, after the initial unstable state, so as to ensure reliable starting of the engine without ignition failure.

After the stable drive condition of the internal combustion engine is obtained, by turning off the switch for the starter motor 11 the rotational speed or rpm of the pinion shaft 14 is gradually reduced and, as a result, the centrifugal force exerted to the governor weight 27 is gradually reduced to zero, whereby the governor weight pieces 27 are urged radially inwardly by the biasing force of the spring 28. As a result, the engagement between the governor weight 27 and shoulder 29*c* of the governor case 29 is released, and the pinion gear 16 and movable cylindrical member 15 are returned along the pinion shaft 14 to the initial position by the dragging torque of the unidirectional clutch 19, due to the rpm of pinion gear 16 which is greater than that of the pinion shaft 14, and the spring force of return spring 22.

It will be understood from the foregoing that the rpm of pinion shaft 14 need not be made greater than the momentary high rpm of pinion gear 16 resulting from the fluctuations of the engine rpm, so that it is possible to reduce the size and capacity of starter motor 11. In addition, it is possible to obtain "snapping", i.e., repeat warm-up operation, without temporarily stopping the starter motor 11. Further, it is possible to obtain operational qualities similar to those of the normally-coupled one-way clutch system used for autobikes and the like, while also obtaining the same functional features as an electromagnetic push-in system. Further, in contrast to the electromagnetic push-in system, there is no possibility of causing coupling by erroneous operation during operation of the engine, and also less noise is produced. Thus, there is no need for malfunction prevention means, and accordingly the starter in accordance with the invention is applicable where the starter switch is likely to be erroneously operated during vehicle running, and can also be inexpensively manufactured.

When the device is repeatedly used for a long period of time, dust is trapped within the casing 12. However, because the pinion shaft 14 is substantially covered by the extension 16*a* of the pinion gear 16 and the cylindrical portion 21*a* of the stopper member 21 as described above, dust cannot easily attach to and collect itself on the pinion shaft 14, i.e., it is possible to isolate and protect the pinion shaft 14 from dust. Even if dust becomes attached to pinion shaft 14, the dust seal 24 provided at the end of extension 16*a* removes dust on the surface of the pinion shaft 14 and prevents it from entering into the gap between the pinion shaft 14 and pinion gear 16, so that smooth movement of the pinion gear 16, which is most important in the Bendix type starter, can be ensured.

Figure 7:
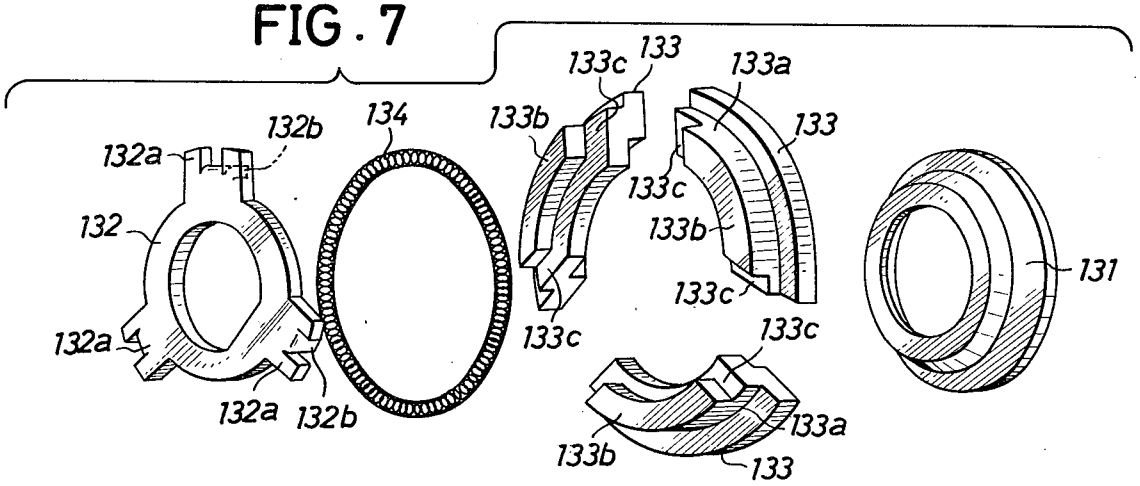
FIG. 7 is an exploded perspective view of a governor weight in the embodiment of FIG. 5.
Figure 5:
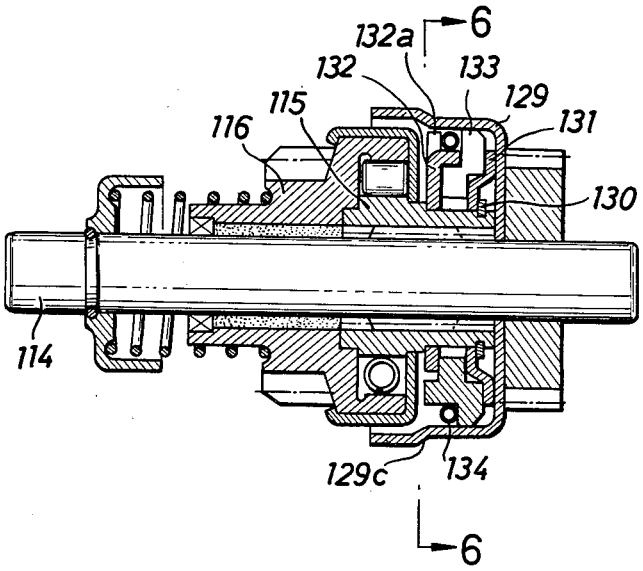
FIG. 5 is a fragmentary axial sectional view showing another embodiment of the starter device according to the invention.
Figure 6:
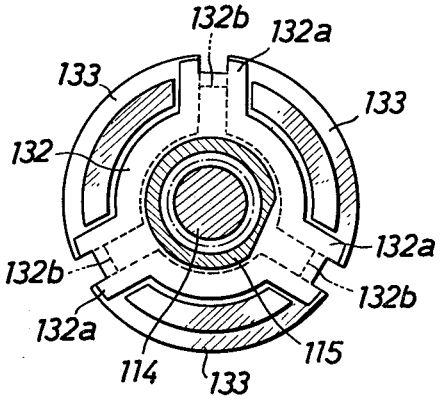
FIG. 6 is a section taken along line 6—6 in FIG. 5.

Another embodiment of the invention will now be described with reference to FIGS. 5, 6 and 7, wherein like parts as those in the preceding embodiment are designated by like reference numerals with an added prefix number 1.

A plate ring 131 is secured by a circular clip 130 to the outer periphery of a rear portion of a movable cylindrical member 115, and also a governor holder 132 is secured thereto in an axially spaced-apart relation to the plate ring 131. A plurality of governor weight pieces 133 which serve as pinion gear retreat-prevention means are mounted between the governor holder 132 and plate ring 131. As shown in FIG. 7, the governor holder 132 has a substantially ring-like configuration having three uniformly spaced-apart radial projections 132*a*. Each projection 132*a* has an intermediate portion 132*b* bent rearwardly at right angles. Each of the plurality (i.e., three in the present embodiment), of governor weight pieces 133 is formed on the front side with a peripheral notch to form a shoulder 133*a*, and also its portion defining the shoulder 133*a* is formed at the opposite ends with radially extending notches to define a front axially-swelled portion 133*b* and guide faces 133*c* extending from the opposite ends of swelled portion 133*b*. Each governor weight piece 133 is interposed between the plate ring 131 and governor holder 132 such that the guide faces 133*c* thereof engage the respectively associated adjacent projections 132*a* of the governor holder 132. Thus, the axial position of the governor weight piece 133 is restricted by the plate ring 131 and governor holder 132, while it is radially movable with its guide faces 133*c* in frictional engagement with the radially extending projections 132*a*. Also, the bent portions 132*b* intervene between adjacent governor weight pieces 133, so that the governor weight pieces 133 are rotated in unison with the movable cylindrical member 115 and governor holder 132. The engagement between the swelled portion 133b of the governor weight 133 and the associated projection 132a of the governor holder 132 permits rotational movement in unison with one another. A ring-like coil spring 132 is accommodated in the peripheral notches defining the shoulders 133a of the governor weight pieces 133. Spring 134 exerts a compressive spring force to, and radially inwardly biases, the governor weight pieces 133. The projections 132a of the governor holder 132 project radially outwardly from the shoulders 133a formed on the front side of governor weight pieces 133 so as to prevent detachment of spring 134.

With the above construction, when the pinion shaft 114 is rotated, the pinion gear 116 is advanced due to the inertia of the movable cylindrical member 115 along the pinion shaft 114 and is brought into meshing engagement with the ring gear at its position corresponding to the limit of advancement. When the pinion gear 116, movable cylindrical member 115 and pinion shaft 114 are thus rotated in unison with one another, the individual governor weight pieces 133 are radially outwardly displaced by centrifugal forces so that they can engage with a shoulder 129c of a governor case 129 (FIG. 5). Thus, as in the previous embodiment, premature detachment of pinion gear 116 from the ring gear, before the establishment of the stable condition of the internal combustion engine, is prevented.

In the present embodiment, the governor weight pieces 133 have a shape which is readily moldable. In other words, they can be produced, for example, by precision casting, molding by sintering, or press molding; which contributes to the stability of machining precision and improvement of productivity.

Figure 8:
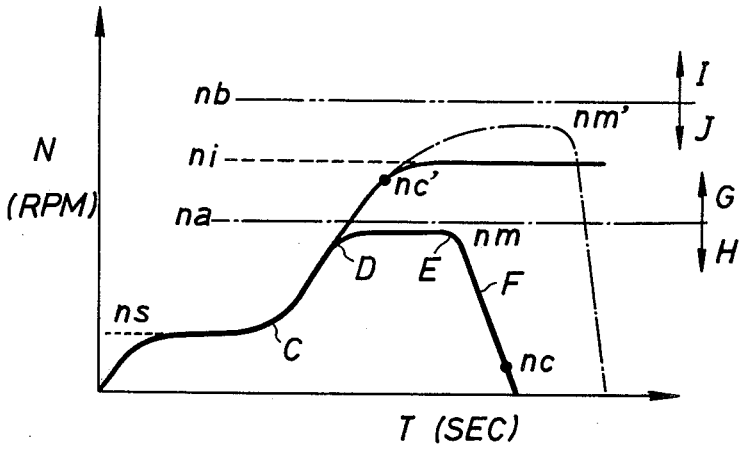
FIG. 8 is a graph comparing the rpm requirements of the starter device according to the invention with a known starter device.
Figure 9:
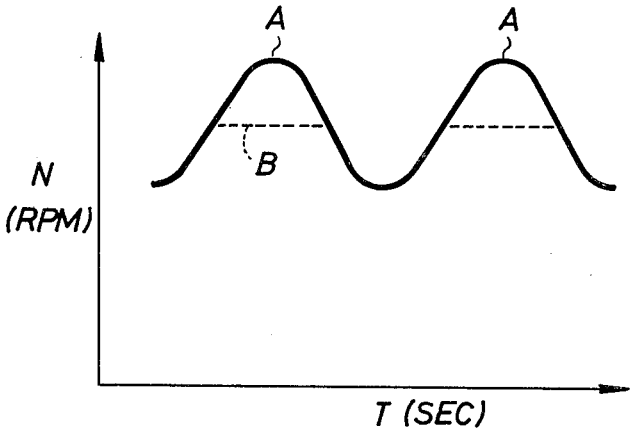
FIG. 9 is a graph showing fluctuations of the rpm of the internal combustion engine in an initial stage after starting rotation.

FIG. 8 is a graph comparing the rpm requirements of a starter motor used in a conventional known starting system, with the starter motor of the starter device according to the present invention. In the graph, the ordinate represents the rpm (N) and the abscissa represents the time (T). In FIG. 8, $n_a$ denotes the idling rpm, and $n_b$ the boundary rpm between stable operating region I and unstable operating region J at the time of low temperature.

With the starter device according to the invention, when a rated starting rpm $n_s$, which is necessary for causing the pinion gear to rotate the ring gear after the movable cylindrical member and pinion gear are advanced due to the inertia thereof with the rotation of the pinion shaft, is exceeded, the internal combustion engine rotates itself to proceed to a stage as shown by a curve portion C of the solid curve. In this stage, the pinion gear receives compulsory torques from the ring gear until a point D is reached, at which the unidirectional clutch decouples the pinion gear from the movable cylindrical member and pinion shaft. Thus, from the point D the starter motor is rotated at its load-free rpm $n_m$. During this time, stable operation of the internal combustion engine is ensured with the early detachment of the pinion gear from the ring gear prevented by the engagement between the governor weight and lock member, i.e., shoulder of the governor case. By turning off the starter motor switch at point E, the rpm of the starter motor is reduced along a curve portion F, which is a straight line. As a result, the centrifugal force acting on the governor weight is reduced to zero, and when the rpm is reduced to $n_c$ the pinion gear is separated from the ring gear.

On the other hand, with the starter motor in the conventional known starter system, it is an essential requirement that the rpm of the pinion shaft always be higher than momentary high rpm values of the internal combustion engine which may result in the initial stage of engine operation, in order to maintain coupling between the pinion gear and ring gear during this stage. Thus, it is necessary that the load-free rpm $n_m'$ is within the stable operation region and is higher than the idling rpm $n_i$, i.e., the rpm of the starter motor and pinion shaft reaches such idling rpm $n_i$, which is higher than the rpm $n_c'$, at which the pinion gear detaches from the ring gear. Because the load-free rpm $n_m'$ must be higher than the idling rpm $n_i$, and also because it is necessary to further increase the motor output in order to ensure reliable starting of the engine even at the time of a low temperature, the motor is inevitably of a large size and high output and capacity ratings.

In accordance with the present invention, however, the load-free rpm $n_m$ of the starter motor need only be higher than the rated rpm $n_s$, so that it is possible to reduce the output and capacity ratings, so as to thus substantially reduce the size of the motor.

Although there have been described what are at present considered to be the preferred embodiments of the invention, it will be understood that the invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

We claim:

1. A starter device for an internal combustion engine, comprising:

a starter motor;

a pinion shaft connected with said starter motor so as to be rotated by said starter motor;

a movable cylindrical member fitted on said pinion shaft and coupled thereto by a helical spline coupling;

a pinion gear fitted for free rotation on said pinion shaft;

a unidirectional clutch provided between said pinion gear and said movable cylindrical member;

said pinion gear and said movable cylindrical member being coupled together for axial movement in unison with each other;

means for preventing retreat of said pinion gear provided on the outer periphery of said movable cylindrical member;

said pinion gear retreat-prevention means being axially fixed in position but radially movable relative to said movable cylindrical member; and a lock member provided at a position in the vicinity of said pinion gear retreat-prevention means so as to be engageable with said pinion gear retreat-prevention means when said pinion gear retreat-prevention means is radially displaced by centrifugal forces.

2. A starter motor for an internal combustion engine according to claim 1, wherein:

said movable cylindrical member and said pinion gear comprise an outer clutch member and an inner clutch member of said unidirectional clutch, respectively.

3. A starter motor for an internal combustion engine according to claim 1, wherein:

said pinion gear retreat-prevention means comprises a governor weight including a plurality of segments capable of being radially outwardly displaced by centrifugal forces.

4. A starter motor for an internal combustion engine according to claim 3, wherein:

said plurality of governor weight segments are retained by a governor holder having substantially ring-like configuration secured to the outer periphery of said movable cylindrical member;

said governor holder has a plurality of peripheral projections; and said governor weight segments are each inserted between adjacent ones of said peripheral projections.

5. A starter device for an internal combustion engine according to claim 3, wherein:

an elastic member is mounted on the outer periphery of said governor weight, said elastic member applying a biasing force to said governor weight for urging said governor weight radially inwardly.

6. A starter device for an internal combustion engine according to claim 5, wherein:

said elastic member comprises a ring-like coil spring.

7. A starter device for an internal combustion engine according to claim 4, wherein:

said governor weight segments are each formed with an inner peripheral groove loosely fitted on the outer peripheral of said governor holder.

8. A starter device for an internal combustion engine according to claim 4, wherein:

said governor weight segments are each arcuate and are provided at the opposite ends in the direction of the arc thereof with grooves extending in the radial direction and fitted on associated peripheral projections of said governor holder.

9. A starter device for an internal combustion engine according to claim 6, wherein:

said governor weight segments are formed with outer peripheral grooves, respectively; and said ring-like spring is accommodated in said outer peripheral grooves.

10. A starter device for an internal combustion engine according to claim 3, wherein:

said lock member comprises a hollow cylindrical member coaxially secured to said pinion shaft so as to accommodate said governor weight.

11. A starter device for an internal combustion engine according to claim 10, wherein:

said hollow cylindrical member is open at the front end thereof, said hollow cylindrical member having a small diameter rear portion, a large diameter front portion, and a shoulder defined between said rear and front portions.

12. A starter device for an internal combustion engine according to claim 1, wherein:

said pinion gear is provided with an annular extension extending forward integrally therewith;

said pinion shaft is provided with a stopper member secured thereto proximal the front end thereof;

said stopper member has a hollow cylindrical portion extending toward said pinion gear; and the surface of said pinion shaft is substantially covered by said annular extension and said hollow cylindrical portion in the retreated position of said pinion gear.

13. A starter device for an internal combustion engine according to claim 12, wherein:

the inner diameter dimension of said hollow cylindrical portion is greater than the outer diameter dimension of said annular extension; and a return spring is provided between said annular extension and said hollow cylindrical member.

14. A starter device for an internal combustion engine according to claim 13, wherein:

a dust seal is fitted in an inner peripheral portion of said annular extension penetrated by said pinion shaft.

15. A starter device for an internal combustion engine according to claim 3, wherein:

a plate ring and a governor holder are secured in an axially spaced-apart relation to each other to the outer periphery of said movable cylindrical member; and said governor weight segments are interposed between said plate ring and said governor holder.

16. A starter device for an internal combustion engine according to claim 15, wherein:

said governor holder is provided with bent portion each intervening between adjacent governor weight segments.

17. A starter device for an internal combustion engine according to claim 15, wherein:

each said governor weight segment has an axially swelled portion and depressed faces adjacent to the opposite ends of said swelled portion;

said governor holder has a plurality of peripheral projections; and each said governor weight segment is interposed between said plate ring and governor holder with said depressed faces being in engagement with the associated peripheral projections.

18. A starter device for an internal combustion engine according to claim 15, wherein:

each said governor weight segment is formed on the front side thereof with a peripheral notch defining a shoulder;

said governor holder has a plurality of peripheral projections projecting further outwardly from said shoulders of said governor weight segments; and a ring-like spring is accommodated within said shoulders of said governor weight segments.

* * * * *